US008257205B2

(12) United States Patent
Mora Vera et al.

(10) Patent No.: US 8,257,205 B2
(45) Date of Patent: Sep. 4, 2012

(54) ANTI-INJURY SPORTS GOALS WITH STANDARDIZED REBOUND

(76) Inventors: Felipe Mora Vera, Valencia (ES); Jose Rafael Vizcaino Cambra, Valencia (ES)

( * ) Notice: Subject to any disclaimer, the term of this patent is extended or adjusted under 35 U.S.C. 154(b) by 144 days.

(21) Appl. No.: 12/664,048

(22) PCT Filed: Jun. 9, 2008

(86) PCT No.: PCT/ES2008/070112

§ 371 (c)(1),
(2), (4) Date: Dec. 10, 2009

(87) PCT Pub. No.: WO2008/152175

PCT Pub. Date: Dec. 18, 2008

(65) Prior Publication Data

US 2010/0179006 A1 Jul. 15, 2010

(30) Foreign Application Priority Data

Jun. 12, 2007 (ES) ..... 200701311 U

(51) Int. Cl.
*A63B 63/00* (2006.01)

(52) U.S. Cl. ..... 473/478; 267/116

(58) Field of Classification Search ..... 473/492, 473/484, 481, 447, 477, 478; 273/400; 73/484; 267/116, 140; 206/586
See application file for complete search history.

(56) References Cited

U.S. PATENT DOCUMENTS 3,104,875 A * 9/1963 Doyle ..... 267/140
3,782,724 A * 1/1974 Rottman et al. ..... 267/140
3,831,941 A * 8/1974 Pease ..... 267/116
4,538,808 A * 9/1985 Holland ..... 473/447
4,600,461 A * 7/1986 Guy ..... 156/244.12
4,874,649 A * 10/1989 Daubenbuchel et al. .... 428/36.5
5,122,569 A * 6/1992 Scheibelhoffer et al. ..... 525/66
5,360,048 A * 11/1994 Lauer ..... 156/86
5,474,721 A * 12/1995 Stevens ..... 264/45.3
5,524,882 A * 6/1996 Wagner ..... 473/477
5,857,928 A * 1/1999 Stewart ..... 473/446
5,947,918 A * 9/1999 Jones et al. ..... 602/58
6,054,078 A * 4/2000 Lauer et al. ..... 264/45.9
6,183,673 B1 * 2/2001 Hartman ..... 264/45.9
6,312,630 B1 * 11/2001 Hartman ..... 264/45.9

(Continued)

OTHER PUBLICATIONS webpage download, paulamar, 2007, http://web.archive.org/web/20081010171952/http://www.paulamar.co.uk/foam/materials.aspx, 3 pages.*

(Continued)

*Primary Examiner* — Gene Kim
*Assistant Examiner* — M Chambers
(74) *Attorney, Agent, or Firm* — Intellectual Property Law Group LLP

(57) ABSTRACT

This invention concerns a goal as used in installations intended for predetermined sports, such as soccer, seven-a-side football, five-a-side football, handball or other similar sports, wherein the goals are generally formed by two vertical side posts and upper horizontal crossbar; said goals have been designed in such a way as to safeguard the physical integrity and protection of sports persons from possible injuries, while at the same time ensuring generation of a standardized rebound. Both the side posts and the crossbar of the goal comprise a rigid core of metal, wood or similar, of variable configuration in transverse cross-section, surrounded by a spongy cellular covering based on epdm, and the latter covered in turn by an external layer of polyethylene coated with polyurethane paint.

8 Claims, 3 Drawing Sheets

U.S. PATENT DOCUMENTS

| | | | | |
|---|---|---|---|---|
| 6,544,448 | B2 * | 4/2003 | Hartman | 264/45.9 |
| 7,150,690 | B1 * | 12/2006 | Cusick | 473/478 |
| 2005/0112320 | A1 | 5/2005 | Wright et al. | |
| 2007/0049431 | A1 * | 3/2007 | Meyer et al. | 473/513 |
| 2010/0179006 | A1 * | 7/2010 | Mora Vera et al. | 473/478 |

OTHER PUBLICATIONS

Product cut sheet, Armacell , 2007, 6 pages.*
WIPO, International Search Report for International Application No. PCT/ES2008/070112.

* cited by examiner

ANTI-INJURY SPORTS GOALS WITH STANDARDIZED REBOUND

CROSS-REFERENCE TO RELATED APPLICATION

This application is a U.S. National Phase application, under 35 U.S.C. §371, of International Application no. PCT/ES2008/070112, with an international filing date of Jun. 9, 2008, which is hereby incorporated by reference for all purposes.

OBJECT OF THE INVENTION

As stated in the title of this descriptive specification, the present invention concerns a sports goal of the kind used for soccer, seven-a-side football, five-a-side football, handball or any other sport requiring the use of goals. The main characteristic and novelty of this goal lies in the fact that it is going to be able to be used for professional and regulated amateur football, since the posts and the crossbars thereof are manufactured with a core of aluminium, mainly, though any other material could be used that will provide it with rigidity. This rigid core is surrounded by a layer of spongy cellular epdm (ethylene propylene diene monomer) in order to dampen the blows received by sports persons when colliding with it, or minimizing the damage produced in the event of its falling on someone. Moreover, around this layer of spongy cellular material is another outer layer of polyethylene painted with polyurethane, and the combination of these elements gives as a result a formula that permits the rebound of the ball to have a behaviour similar to that of goals that are currently used for playing professional or amateur matches since otherwise, although they would prevent injuries, by having a flexible material around them, with the goals that currently exist the official bodies would not give their approval to them since the rebound would not be the same. But with this innovation, the object of our invention, our goals will thus be able to have a professional and regulated amateur use.

BACKGROUND OF THE INVENTION

In sports such as football, handball or others, the goals used are made of steel, iron, aluminium or wood, which makes them dangerous for playing these sports, even though some of them have a covering of a flexible material in order not to cause injuries. This covering, however, although it is of interest for domestic use or at the level of children's games, does not comply with the regulations and in fact it is not used at the professional level, in other words: from Second Division B up to the First Division or similar categories in other parts of the world, nor in regulated amateur leagues, in other words, the entire basis of football, from the most junior teams up to the Third Division. In these cases the goals do not have an inner covering of spongy epdm nor an outer one of polyethylene painted with polyurethane, whose combination of formulas of density and shores allows the rebound of the ball to have the same behaviour as with goals that are not covered. Likewise, given that they are also going to be used in schools and sports complexes, an extremely important property of our formula is that it is fireproof, and so it presents no danger of catching fire. Equally, the spongy cellular epdm has the property of repelling water and the layer of polyethylene painted with polyurethane has the property of being impermeable, and the combination of both formulas means that the covering will not deteriorate as a consequence of atmospheric phenomena and end up by losing the standardized rebound property of the ball.

DESCRIPTION OF THE INVENTION

In order to achieve the objectives and avoid the drawbacks stated above, the invention comprises a goal of the kind used for soccer, seven-a-side football, five-a-side football or handball, etc., which is manufactured with a preferably aluminium core though it can also be manufactured in steel, iron, wood or recycled material since the inner part merely has the function of providing consistency for the structure of the goal, and which will be surrounded by a spongy cellular epdm layer with an approximate density of 50 kg/m$^3$ and around this another layer of polyethylene of approximate density: 1.12 to 1.20 g/cm$^3$ and approximate hardness of 92 (+/−) shores A, painted with polyurethane. These densities and shores can be increased or decreased according to the use for soccer, five-a-side football or handball Likewise, the goals can be constructed to be fixed or dismantable, with a rear frame or without it, movable, etc., in other words, they can be of any kind of those currently existing in the state of the art and on the market, in addition to complying with FIFA regulations, in its law 1, decision 2 of the International FA Board which reads literally: "goalposts and crossbars must be made of wood, metal or other approved material. Their shape may be square, rectangular, round or elliptical and they must not be dangerous to players . . . ".

With regard to the measurements, the FIFA regulations likewise state:

Goals will consist of two upright posts equidistant from the corner flagposts and joined at the top by a horizontal bar (crossbar). The distance between the posts is 7.32 m and the distance from the lower edge of the crossbar to the ground is 2.44 m. The goalposts and the crossbar have the same width and depth, which do not exceed 12 cm. The goalposts and crossbars must be white. All these specifications are met by our goals, given that the inner tubes, plus the spongy epdm covering and then the layer of polyethylene painted with polyurethane, all this the object of our invention, add up to a total of 12 cm, which is what FIFA sets as the maximum. With this same formulation the handball goals will be manufactured so that they too are adapted to the measurements demanded by the IHF, apart from the fact that they will be finished in white and red as demanded by their regulations.

Below, in order to facilitate a better understanding of this descriptive specification and forming an integral part thereof, some figures are attached in which the object of the invention has been represented in an illustrative and non-limiting manner.

DESCRIPTION OF ONE OR SEVERAL EXAMPLES OF EMBODIMENT

Figure 1:
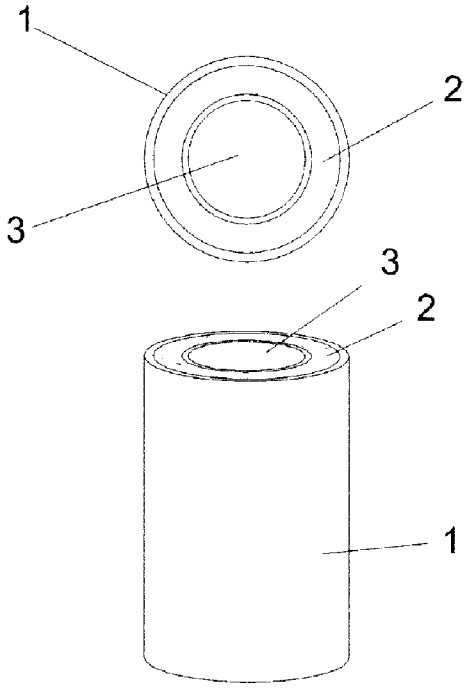
FIG. 1 Represents a cut through the tube of the football goal, in this case circular, where the cross-section (3) represents the tube made of metal or other standardized material which will be surrounded by a spongy epdm covering (2) and this in turn covered by polyethylene painted with polyurethane (1).
Figure 2:
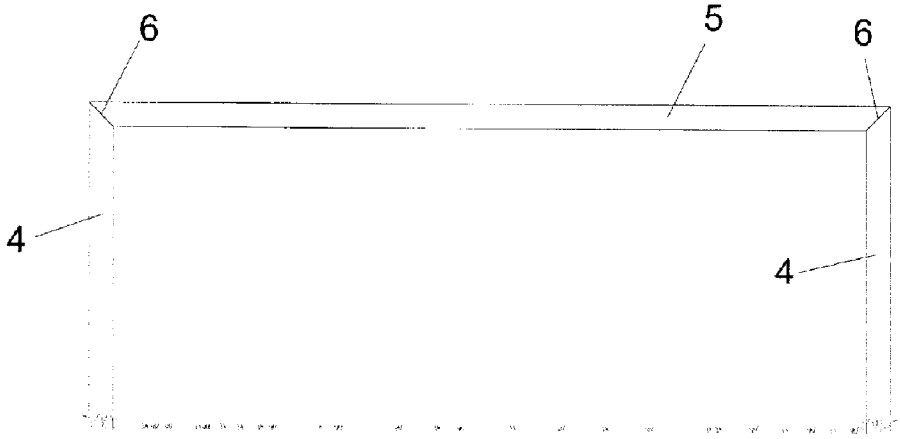
FIG. 2 Represents a front view of the football goal standardized by FIFA with posts (4), crossbar (5) and miter cuts (6) in the corners or angles, all this done with the protection forming the object of our invention which will be painted white.
Figure 3:
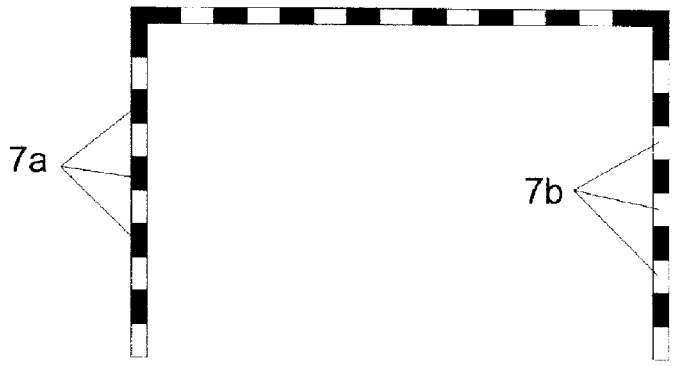
FIG. 3 Represents a front view of a handball goal manufactured with the protection forming the object of our invention and where the reference (7*a*) marks the sections painted in red and the reference (7*b*) marks the sections painted in white, in order to adapt ourselves to the regulations of the IHF.
Figure 4:
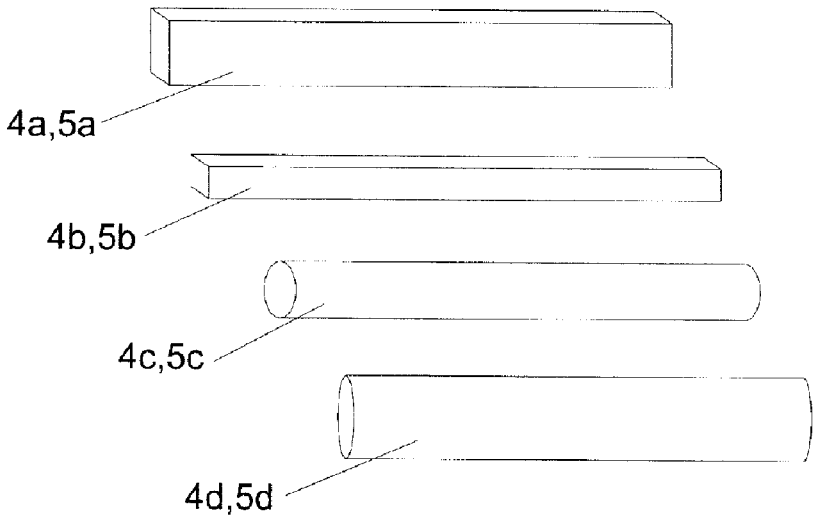
FIG. 4 Represents a view of the different types of posts and crossbars standardized by FIFA for football, in other words rectangular posts and crossbars (4*a*, 5*a*), square posts and crossbars (4*b*, 5*b*), round posts and crossbars (4*c*, 5*c*) and elliptical posts and crossbars (4*d*, 5*d*), with the embodiments corresponding to (4*b*, 5*b*) or to (4*a*, 5*a*) being for handball.
Figure 5:
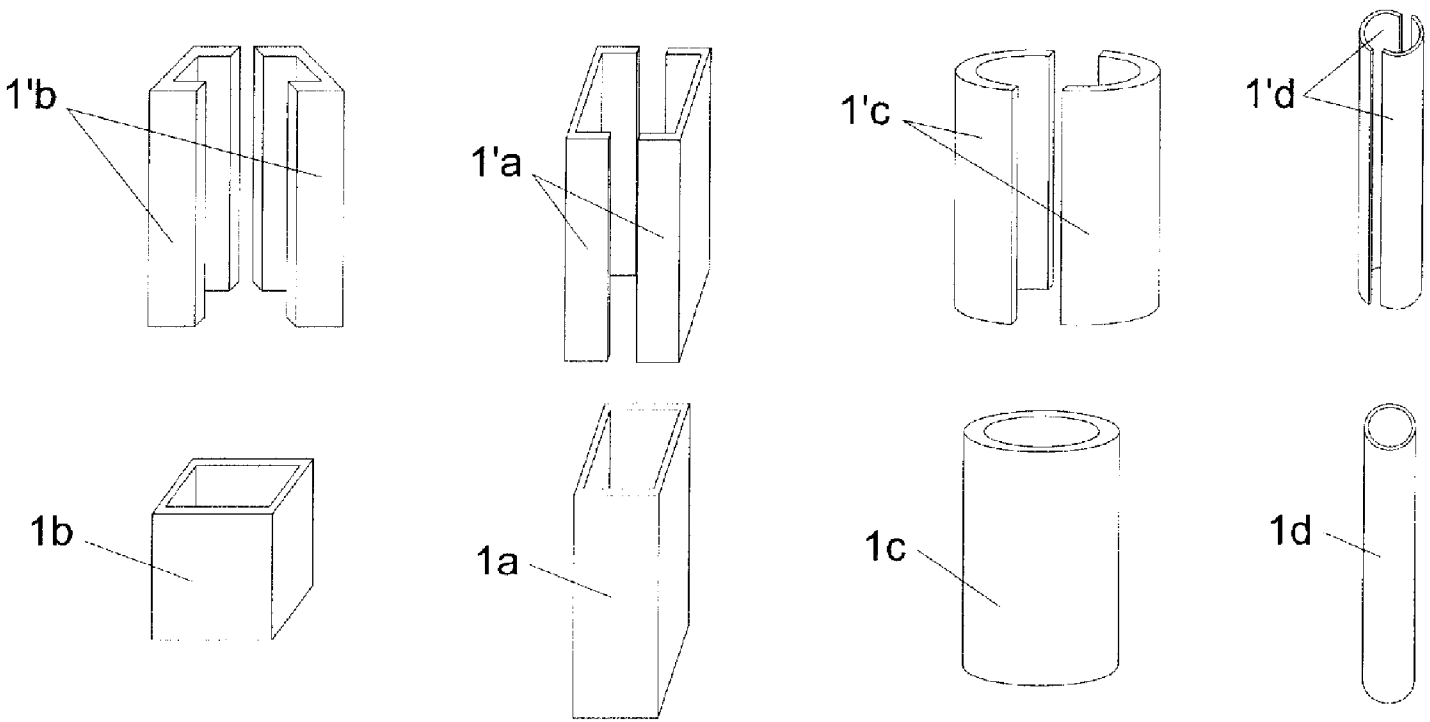
FIG. 5 Represents a front view of the different exterior coverings divided into two pieces which we are going to use for covering our goals, the reference (1'*b*) being that of a square shape, the reference (1'*a*) that of a rectangular shape, the reference (1'*c*) that of an elliptical shape and the reference (1'*d*) that of a circular shape. In terms of the entire coverings, undivided, the reference (1*b*) will be that of a square cross-section, the reference (1*a*) that of a rectangular cross-section, the reference (1*c*) that of an elliptical cross-section and the reference (1*d*) that of a circular cross-section.

A description of an example of embodiment is going to be made forthwith.

So, the embodiment could consist of using a tube (3) made of aluminium or any other firm material, which will be able to be solid or hollow or even be filled or not with any solid, liquid or gaseous material, around which will be placed the spongy epdm (2) with the characteristics mentioned above, to which will have been added the polyethylene (1) painted with polyurethane being introduced in the tube (3) by means of a system of 'swelling' with air so that it fits the walls of the tube perfectly, which will be able to be cut in the form of a mitre, as shown with (6), in order to be able to adapt the posts (4) to the crossbar (5) of the goal, and so that it can be easily assembled and dismantled with the aim of better transportation.

The invention claimed is:

1. An anti-injury sports goal with a standardized rebound, comprising:

a plurality of posts and a plurality of crossbars, each manufactured with a rigid core of aluminum, steel, iron, wood or recycled material, each rigid core having a plurality of walls surrounded by a spongy cellular ethylene propylene diene monomer covering (EPDM) in an inner part, and in turn covered by an outer layer of a polyethylene coated with a polyurethane paint; and the covering surrounding the rigid core incorporated by a means of swelling with air, such that the covering perfectly fits the walls of the rigid core.

2. The sports goal according to claim 1, wherein the spongy cellular EPDM covering surrounding the rigid core has an approximate material density of 50 kg/m$^3$.

3. The sports goal according to claim 2, wherein the polyethylene constituting the outer layer is selected to have a material density between 1.12 and 1.20 g/cm$^3$ and a hardness of approximately 92 Shore A.

4. The sports goal according to claim 1, wherein the polyethylene constituting the outer layer is selected to have a material density between 1.12 and 1.20 g/cm$^3$ and a hardness of approximately 92 Shore A.

5. The sports goal according to claim 1, wherein each of the plurality of posts and the plurality of crossbars are configured with a transverse cross section selected from the group consisting of a circular transverse cross-section and an elliptical transverse cross-section.

6. The sports goal according to claim 5, wherein the polyethylene constituting the outer layer is selected to have a material density between 1.12 and 1.20 g/cm$^3$ and a hardness of approximately 92 Shore A.

7. The sports goal according to claim 5, wherein the spongy cellular EPDM covering surrounding the rigid core has an approximate material density of 50 kg/m$^3$.

8. The sports goal according to claim 7, wherein the polyethylene constituting the outer layer is selected to have a material density between 1.12 and 1.20 g/cm$^3$ and a hardness of approximately 92 Shore A.

* * * * *